US010024218B2

(12) United States Patent
Nose

(10) Patent No.: US 10,024,218 B2
(45) Date of Patent: Jul. 17, 2018

(54) V8 ENGINE AND OUTBOARD MOTOR

(71) Applicant: YAMAHA HATSUDOKI KABUSHIKI KAISHA, Iwata-shi, Shizuoka (JP)

(72) Inventor: Yukinori Nose, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 439 days.

(21) Appl. No.: 15/003,822

(22) Filed: Jan. 22, 2016

(65) Prior Publication Data

US 2016/0341097 A1 Nov. 24, 2016

(30) Foreign Application Priority Data

May 18, 2015 (JP) ..... 2015-101209

(51) Int. Cl.

| | |
|---|---|
| ***F02B 25/08*** | (2006.01) |
| ***F01N 13/10*** | (2010.01) |
| ***F01L 1/08*** | (2006.01) |
| ***F01N 3/10*** | (2006.01) |
| ***F02B 75/22*** | (2006.01) |
| ***F02B 61/04*** | (2006.01) |
| *F02B 75/18* | (2006.01) |
| *F01L 1/053* | (2006.01) |

(52) U.S. Cl.

CPC ..... *F01N 13/10* (2013.01); *F01L 1/08* (2013.01); *F01N 3/10* (2013.01); *F02B 61/045* (2013.01); *F02B 75/22* (2013.01); *F01L 2001/0537* (2013.01); *F01L 2800/08* (2013.01); *F01N 2590/021* (2013.01); *F02B 2075/1832* (2013.01)

(58) Field of Classification Search

CPC ..... Y02T 10/18; F01L 2800/08; F01L 1/34; F02B 75/22; F02B 2075/1832

USPC ..... 123/90.15, 51 A; 701/105

See application file for complete search history.

(56) References Cited

U.S. PATENT DOCUMENTS

| | | | | |
|---|---|---|---|---|
| 8,844,487 | B2 * | 9/2014 | Min | F02D 13/0249 123/90.27 |
| 9,255,497 | B2 * | 2/2016 | Whiston | F01L 1/047 |
| 2009/0007550 | A1 * | 1/2009 | Konakawa | F01N 3/22 60/299 |

(Continued)

FOREIGN PATENT DOCUMENTS

JP 2008-031897 A 2/2008

*Primary Examiner* — Marguerite McMahon
*Assistant Examiner* — James Kim
(74) *Attorney, Agent, or Firm* — Keating and Bennett, LLP

(57) ABSTRACT

An eight cylinder engine includes cylinders that are fired at intervals corresponding to a crank angle of 90 degrees. The firing is conducted in four cylinders of each of first and second banks at uneven intervals. In a pair of cylinders of each of the banks in which the firing is consecutively conducted at an interval corresponding to a crank angle of 90 degrees, a central angle of an exhaust cam provided for one cylinder in which the firing is conducted later is larger than that of an exhaust cam provided for the other cylinder. In a pair of cylinders of each of the banks in which the firing is consecutively conducted at an interval corresponding to a crank angle of 270 degrees, a central angle of an exhaust cam provided for one cylinder in which the firing is conducted later is larger than that of an exhaust cam provided for the other cylinder.

15 Claims, 12 Drawing Sheets

(56) References Cited

U.S. PATENT DOCUMENTS

2014/0223987 A1* 8/2014 Shimada ..... F02D 41/1443
73/1.06

* cited by examiner

| | WA | EA |
|---|---|---|
| INTAKE C1,C6 | 248 | 118 |
| INTAKE C2,C3 | 248 | 118 |
| INTAKE C4,C7 | 248 | 118 |
| INTAKE C5,C8 | 248 | 118 |
| | | |
| EXHAUST C1,C6 | 240 | 110 |
| EXHAUST C2,C3 | 240 | 115 |
| EXHAUST C4,C7 | 240 | 115 |
| EXHAUST C5,C8 | 240 | 110 |

FIG. 7

| | WA | EA |
|---|---|---|
| INTAKE C1,C6 | 248 | 118 |
| INTAKE C2,C3 | 248 | 118 |
| INTAKE C4,C7 | 248 | 118 |
| INTAKE C5,C8 | 248 | 118 |
| | | |
| EXHAUST C1,C6 | 240 | 110 |
| EXHAUST C2,C3 | 240 | 115 |
| EXHAUST C4,C7 | 240 | 115 |
| EXHAUST C5,C8 | 240 | 105 |

FIG. 8

| | WA | EA |
|---|---|---|
| INTAKE C1-C8 | 248 | 128 |
| EXHAUST C1-C8 | 240 | 110 |

FIG. 9

| | BMEP | HP | VOLUME EFFICIENCY |
|---|---|---|---|
| FIRST PRACTICAL EXAMPLE | 11.2567 | 419.6 | 97.86 |
| SECOND PRACTICAL EXAMPLE | 11.2871 | 420.7 | 98.12 |
| COMPARATIVE EXAMPLE | 11.1225 | 414.6 | 97.14 |

FIG. 10

V8 ENGINE AND OUTBOARD MOTOR

BACKGROUND OF THE INVENTION

1. Field of the Invention

The present invention relates to a V8 engine and an outboard motor including the V8 engine.

2. Description of the Related Art

V8 engines (eight-cylinder V engines) include a first bank of four cylinders and a second bank of four cylinders. The first bank and the second bank are disposed in a V shape. In V8 engines, firing is conducted eight times within a crank angle of 720 degrees. Therefore, when firing intervals are even, firing is conducted at intervals respectively corresponding to a crank angle of 90 degrees. When a cross-plane crankshaft is used, firing is conducted at uneven intervals in each of the first and second banks.

In the engines, exhaust valves are opened before pistons reach the bottom dead center in an exhaust process. At this time, a phenomenon called exhaust blowdown occurs. In the exhaust blowdown, burnt gas rushes out to an exhaust system due to high pressure in a cylinder.

When cylinders are respectively connected to a common exhaust pathway, high pressure attributed to the exhaust blowdown in a given cylinder is transferred to another cylinder via the exhaust pathway. Therefore, when two cylinders, in which firing is conducted in close sequence, are connected through the exhaust pathway, there is a possibility that the high pressure attributed to the exhaust blowdown in one cylinder interferes with exhaustion of the other cylinder.

To inhibit the exhaust interference described above, Japan Laid-open Patent Application Publication No. 2008-31897 discloses a construction in which cylinders are paired off and connected through four exhaust pathways such that firing is conducted in each pair of cylinders at an interval corresponding to a crank angle of 360 degrees. Moreover, the four exhaust pathways are joined and integrated into two exhaust pathways. With the above construction, exhaust interference is inhibited.

SUMMARY OF THE INVENTION

However, in the construction disclosed in Japan Laid-open Patent Application Publication No. 2008-31897, the exhaust pathways have complex structures and large sizes. Therefore, it is not easy to reduce the size of an outboard motor equipped with the aforementioned engine.

Preferred embodiments of the present invention inhibit exhaust interference in a V8 engine with a simple construction.

A V8 engine according to a preferred embodiment of the present invention includes a first bank, a second bank, an exhaust pathway, exhaust valves, and exhaust cams. The first bank includes four cylinders. The second bank includes four cylinders and is disposed in a V-shaped alignment with the first bank. The exhaust pathway includes a first aggregated portion and a second aggregated portion. The first aggregated portion joins exhaust gases from the four cylinders of the first bank therein. The second aggregated portion joins exhaust gases from the four cylinders of the second bank therein. Each of the exhaust valves is provided for each of the cylinders, and opens and closes each of exhaust ports of the cylinders. Each of the exhaust cams is provided for each of the cylinders, and drives each of the exhaust valves of the cylinders. Firing is conducted in the eight cylinders at intervals respectively corresponding to a crank angle of 90 degrees. Firing is conducted in the four cylinders of the first bank at uneven intervals. Firing is conducted in the four cylinders of the second bank at uneven intervals. In a pair of cylinders of the first bank in which firing is consecutively conducted at an interval corresponding to a crank angle of 90 degrees, a central angle of the exhaust cam provided for one cylinder in which the firing is conducted later is larger than a central angle of the exhaust cam provided for the other cylinder in which the firing is conducted earlier. In a pair of cylinders of the second bank in which the firing is consecutively conducted at an interval corresponding to a crank angle of 90 degrees, a central angle of the exhaust cam provided for one cylinder in which the firing is conducted later is larger than a central angle of the exhaust cam provided for the other cylinder in which the firing is conducted earlier. In a pair of cylinders of the first bank in which the firing is consecutively conducted at an interval corresponding to a crank angle of 270 degrees, a central angle of the exhaust cam provided for one cylinder in which the firing is conducted later is larger than a central angle of the exhaust cam provided for the other cylinder in which the firing is conducted earlier. In a pair of cylinders of the second bank in which the firing is consecutively conducted at an interval corresponding to a crank angle of 270 degrees, a central angle of the exhaust cam provided for one cylinder in which the firing is conducted later is larger than a central angle of the exhaust cam provided for the other cylinder in which the firing is conducted earlier.

A V8 engine according to another preferred embodiment of the present invention includes a first bank, a second bank, an exhaust pathway, exhaust valves, and exhaust cams. The first bank includes four cylinders. The second bank includes four cylinders and is disposed in a V-shaped alignment with the first bank. The exhaust pathway includes a first aggregated portion and a second aggregated portion. The first aggregated portion joins exhaust gases from the four cylinders of the first bank therein. The second aggregated portion joins exhaust gases from the four cylinders of the second bank therein. Each of the exhaust valves is provided for each of the cylinders, and opens and closes each of exhaust ports of the cylinders. Each of the exhaust cams is provided for each of the cylinders, and drives each of the exhaust valves of the cylinders. Firing is conducted in the eight cylinders at intervals respectively corresponding to a crank angle of 90 degrees. When firing is conducted first in a predetermined cylinder of the eight cylinders, a central angle of the exhaust cam provided for a cylinder in which the firing is conducted seventh is larger than a central angle of the exhaust cam provided for the predetermined cylinder in which the firing is conducted first. A central angle of the exhaust cam provided for a cylinder in which the firing is conducted third is larger than a central angle of the exhaust cam provided for a cylinder in which the firing is conducted fifth. A central angle of the exhaust cam provided for a cylinder in which the firing is conducted fourth is larger than a central angle of the exhaust cam provided for a cylinder in which the firing is conducted sixth. A central angle of the exhaust cam provided for a cylinder in which the firing is conducted eighth is larger than a central angle of the exhaust cam provided for a cylinder in which the firing is conducted second.

An outboard motor according to a preferred embodiment of the present invention includes the above-described V8 engine, a driveshaft, and a propeller shaft. The driveshaft is driven by the engine, and extends in a vertical direction. The propeller shaft is connected to the driveshaft, and extends in a direction perpendicular or substantially perpendicular to the driveshaft.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 7 is a table for showing settings of the intake cams and the exhaust cams of the first to eighth cylinders according to a first practical example.

FIG. 8 is a table for showing settings of the intake cams and the exhaust cams of the first to eighth cylinders according to a second practical example.

FIG. 9 is a table for showing settings of the intake cams and the exhaust cams of the first to eighth cylinders according to a comparative example.

FIG. 10 is a table for showing values of maximum BMEP, output horsepower, and volumetric efficiency in the first practical example, those in the second practical example, and those in the comparative example.

DETAILED DESCRIPTION OF THE PREFERRED EMBODIMENTS

Figure 1:
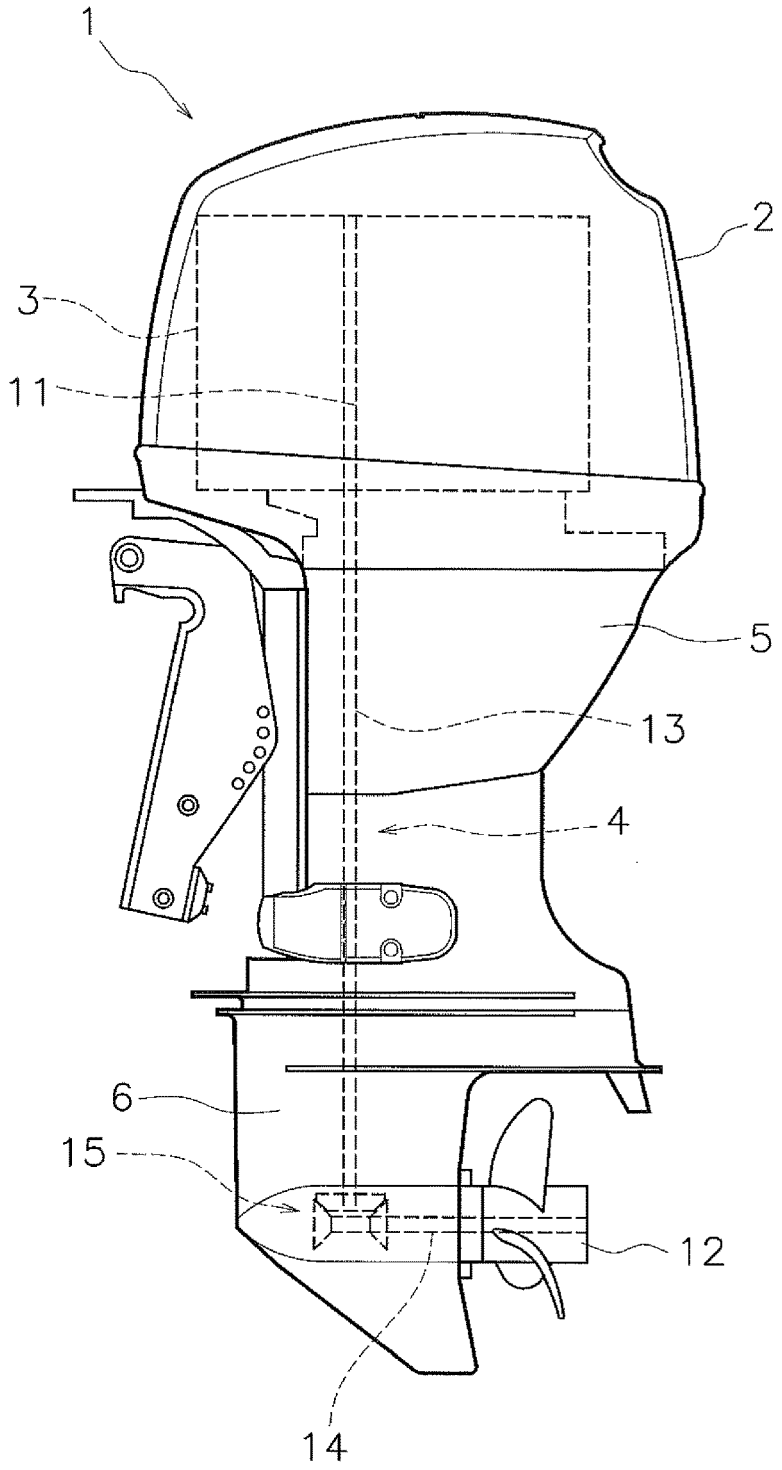
FIG. 1 is a side view of an outboard motor according to a preferred embodiment of the present invention.

Preferred embodiments of the present invention will be hereinafter explained with reference to the attached drawings. FIG. 1 is a side view of an outboard motor 1 according to a preferred embodiment of the present invention. The outboard motor 1 includes an engine cover 2, an engine 3, a power transmission mechanism 4, an upper case 5, and a lower case 6. The engine cover 2 covers the engine 3. The engine 3 includes a crankshaft 11. The crankshaft 11 extends in the vertical direction.

The power transmission mechanism 4 transmits a driving force from the engine 3 to a propeller 12. The power transmission mechanism 4 includes a driveshaft 13, a propeller shaft 14, and a shift mechanism 15. The driveshaft 13 extends in the vertical direction. The driveshaft 13 is coupled to the crankshaft 11 and is rotated by the engine 3.

The propeller shaft 14 is coupled to a lower portion of the driveshaft 13 through the shift mechanism 15. The propeller shaft 14 extends in the back-and-forth direction. The propeller shaft 14 extends perpendicular or substantially perpendicular to the driveshaft 13. The propeller 12 is attached to the rear end of the propeller shaft 14. The propeller shaft 14 transmits a driving force from the driveshaft 13 to the propeller 12.

The propeller 12 is disposed in a lower portion of the outboard motor 1. The propeller 12 is rotationally driven by the driving force from the engine 3. The shift mechanism 15 switches the rotational direction of a power transmitted from the driveshaft 13 to the propeller shaft 14.

The upper case 5 is disposed under the engine cover 2. The upper case 5 covers the driveshaft 13. The lower case 6 is disposed under the upper case 5. The lower case 6 covers the propeller shaft 14.

Figure 2:
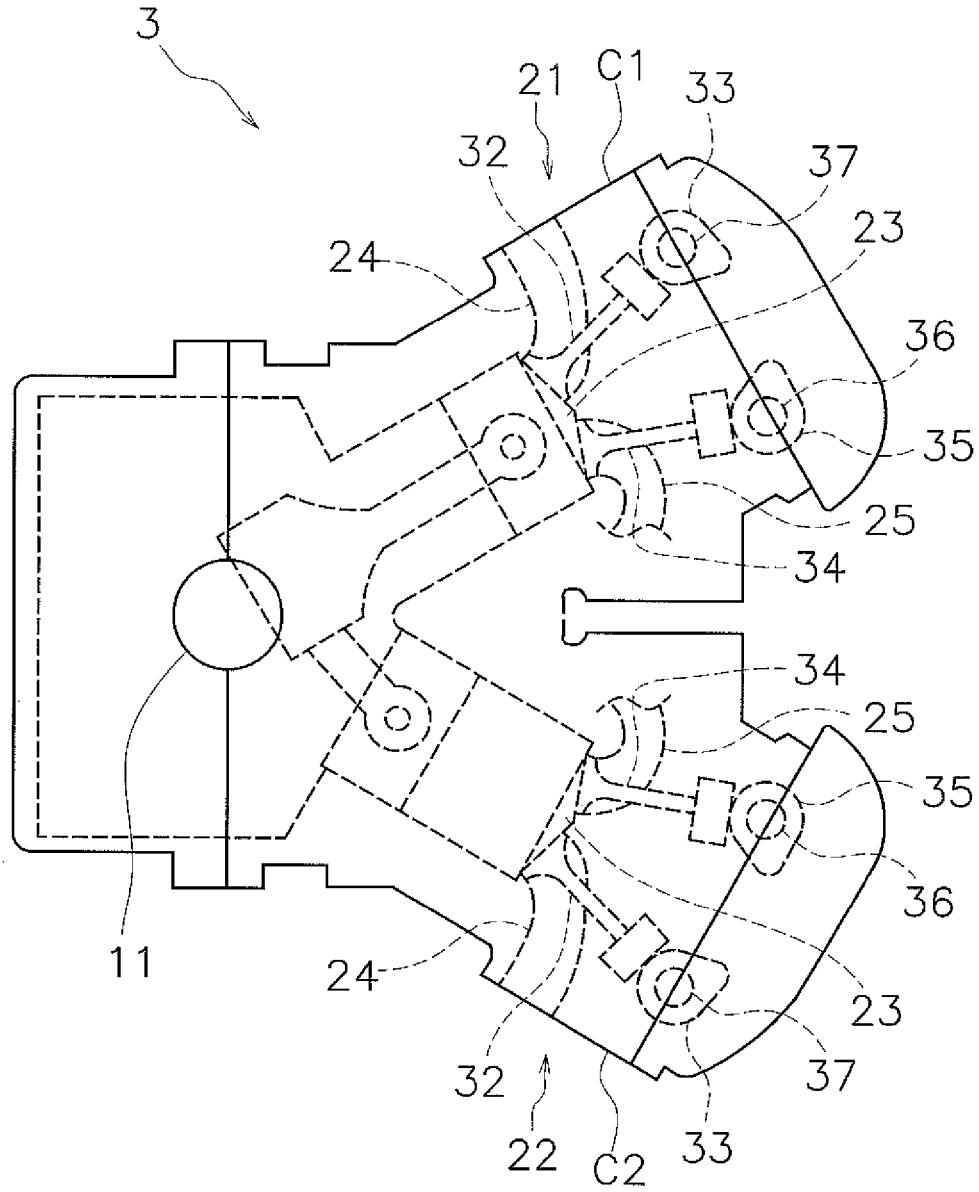
FIG. 2 is a plan view of an engine.
Figure 3:
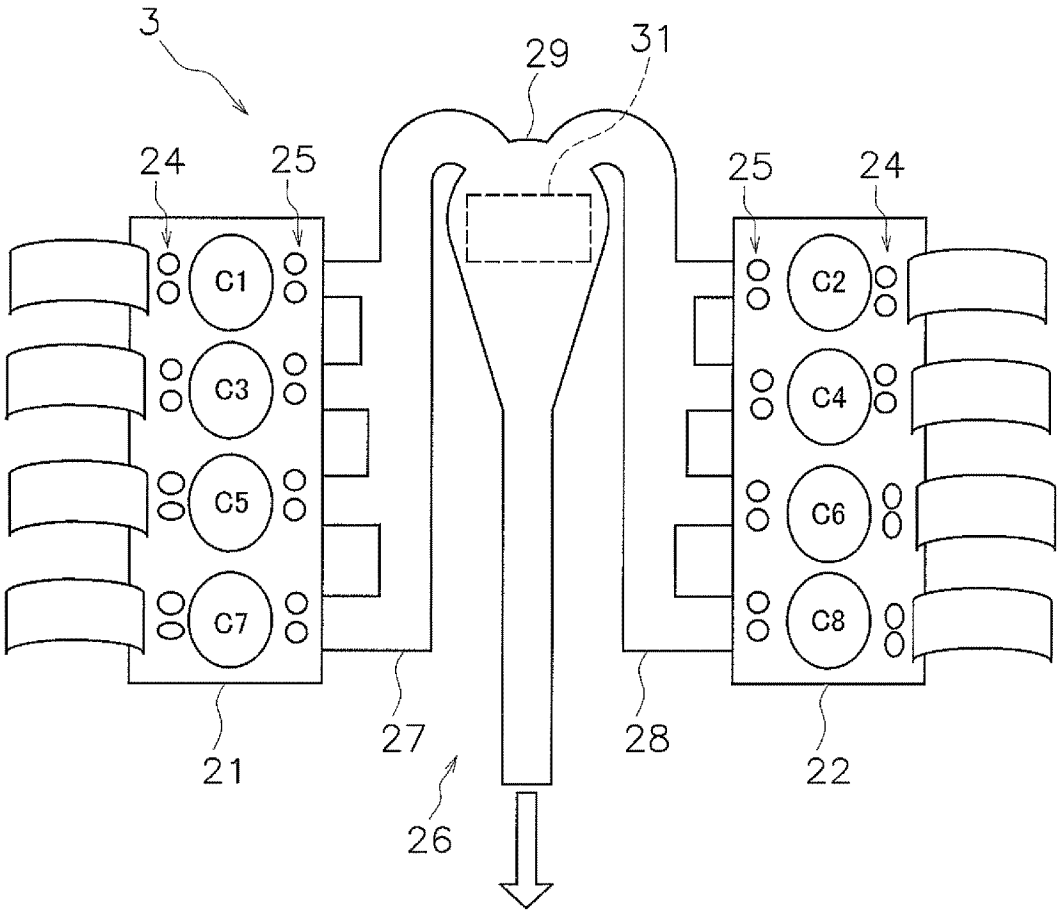
FIG. 3 is a schematic diagram of a construction of the engine.

Next, the engine 3 will be explained in detail. FIG. 2 is a plan view of the engine 3. FIG. 3 is a schematic diagram of a construction of the engine 3. The engine 3 includes a first bank 21 and a second bank 22. As shown in FIG. 3, the first bank 21 includes four cylinders C1, C3, C5, and C7. The second bank 22 includes four cylinders C2, C4, C6, and C8, and is disposed in a V-shaped alignment with the first bank 21. In other words, the engine 3 is a V8 engine (eight-cylinder V-shaped engine).

As shown in FIG. 2, each of the cylinders C1 to C8 includes a combustion chamber 23, an intake port 24, and an exhaust port 25. The intake port 24 and the exhaust port 25 are connected to the combustion chamber 23.

As shown in FIG. 3, the engine 3 includes an exhaust pathway 26. The exhaust pathway 26 includes a first aggregated portion 27 and a second aggregated portion 28. The first aggregated portion 27 is connected to the exhaust ports 25 of the four cylinders C1, C3, C5, and C7 of the first bank 21. The first aggregated portion 27 joins the exhaust gases from the four cylinders C1, C3, C5, and C7 of the first bank 21 therein. The second aggregated portion 28 is connected to the exhaust ports 25 of the four cylinders C2, C4, C6, and C8 of the second bank 22. The second aggregated portion 28 joins the exhaust gases from the four cylinders C2, C4, C6, and C8 of the second bank 22 therein. The first aggregated portion 27 and the second aggregated portion 28 are disposed between the first bank 21 and the second bank 22.

The exhaust pathway 26 includes a third aggregated portion 29. The third aggregated portion 29 is connected to the first aggregated portion 27 and the second aggregated portion 28. The third aggregated portion 29 joins the first aggregated portion 27 and the second aggregated portion 28. The third aggregated portion 29 is disposed between the first bank 21 and the second bank 22. A catalyst 31 is disposed within the third aggregated portion 29. The catalyst 31 purifies exhaust gas passing through the exhaust pathway 26.

As shown in FIG. 2, the engine 3 includes a plurality of intake valves 32 and a plurality of intake cams 33. Each of the intake valves 32 is provided for each of the cylinders C1 to C8. Each of the intake valves 32 opens and closes each of the intake ports 24 of the cylinders C1 to C8. Each of the intake cams 33 is provided for each of the cylinders C1 to C8. Each of the intake cams 33 is rotationally driven by its corresponding intake camshaft 37, such that each of the intake valves 32 of the cylinders C1 to C8 is driven.

The engine 3 includes a plurality of exhaust valves 34 and a plurality of exhaust cams 35. Each of the exhaust valves 34 is provided for each of the cylinders C1 to C8. Each of the exhaust valves 34 opens and closes each of the exhaust ports 25 of the cylinders C1 to C8. Each of the exhaust cams 35 is provided for each of the cylinders C1 to C8. Each of the exhaust cams 35 is rotationally driven by its corresponding exhaust camshaft 36, such that each of the exhaust valves 34 of the cylinders C1 to C8 is driven.

As shown in FIG. 3, the first bank 21 includes a first cylinder C1, a third cylinder C3, a fifth cylinder C5, and a seventh cylinder C7. The first cylinder C1, the third cylinder C3, the fifth cylinder C5, and the seventh cylinder C7 are disposed in this order in the first bank 21. The second bank 22 includes a second cylinder C2, a fourth cylinder C4, a sixth cylinder C6, and an eighth cylinder C8. The second cylinder C2, the fourth cylinder C4, the sixth cylinder C6, and the eighth cylinder C8 are disposed in this order in the second bank 22.

Figure 4:
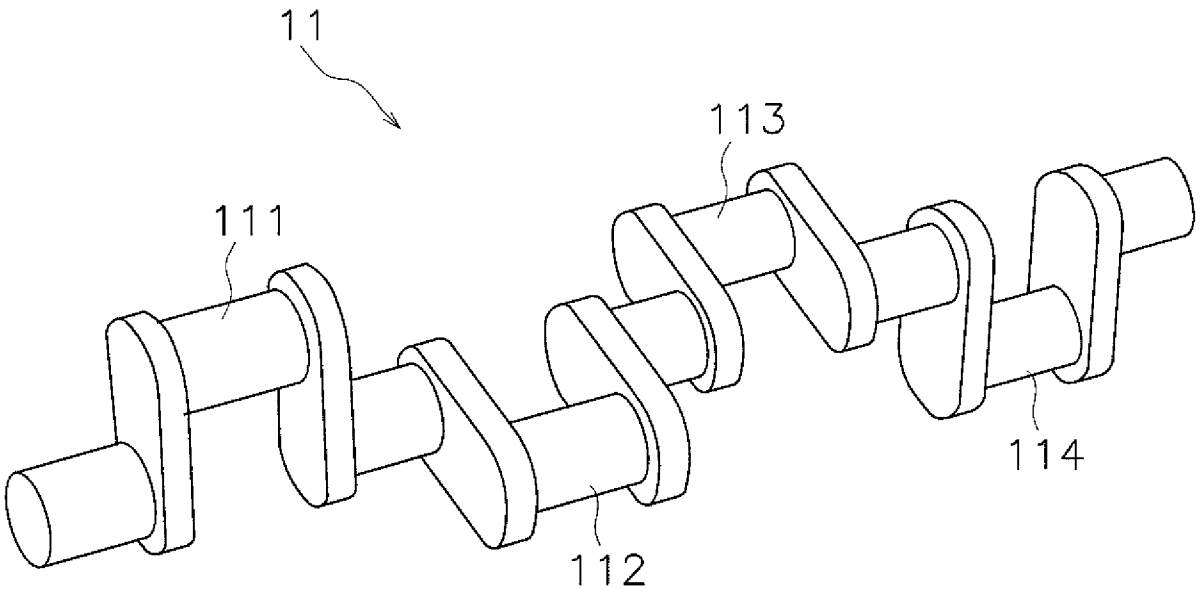
FIG. 4 is a perspective view of a crankshaft.

Firing is conducted in the eight cylinders C1 to C8 at intervals respectively corresponding to a crank angle of 90 degrees. Therefore, the crankshaft 11 is a cross-plane crankshaft shown in FIG. 4, and four crankpins 111 to 114 are disposed at 90 degrees apart.

Figure 5:
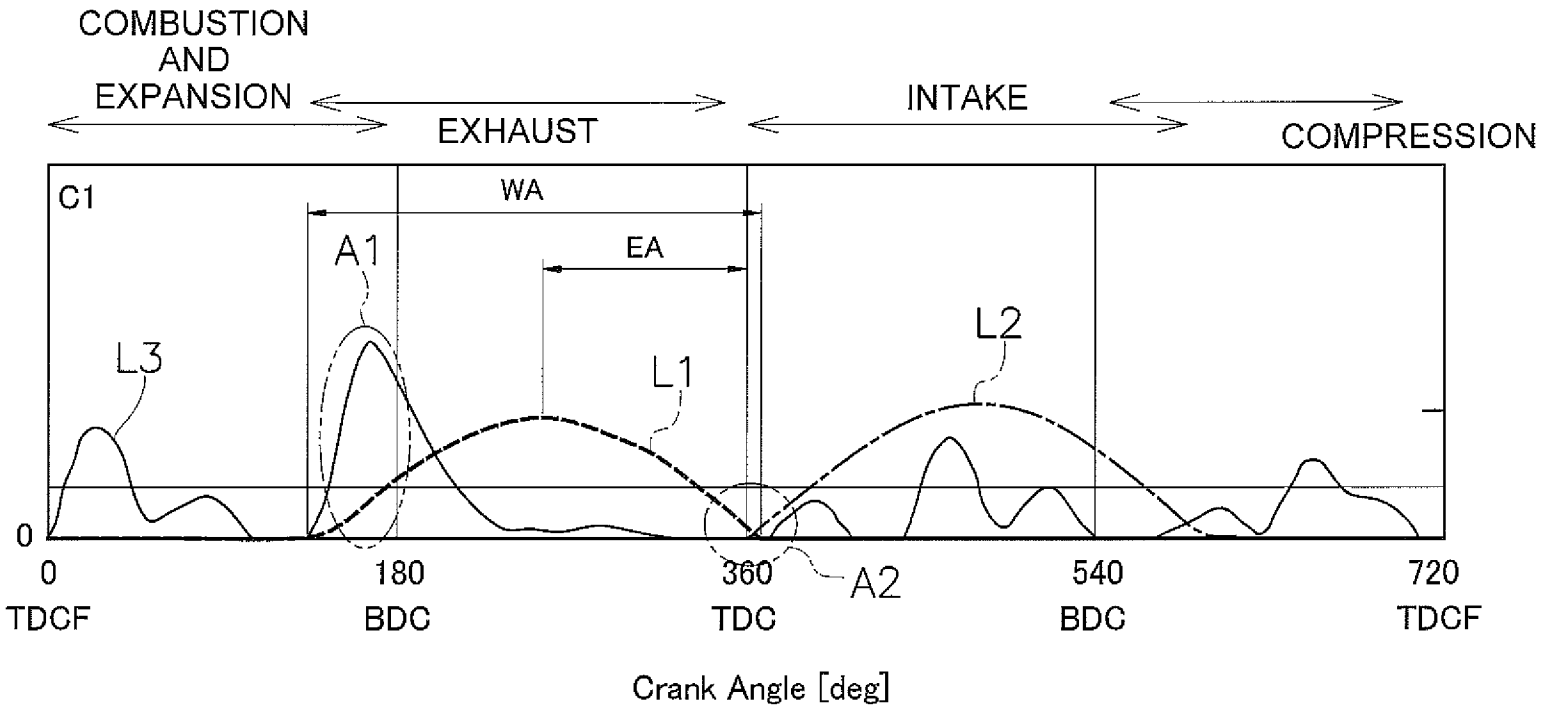
FIG. 5 is a timing chart for showing the phase of an intake cam, the phase of an exhaust cam, and exhaust pressure in a first cylinder.

FIG. 5 is a timing chart showing the phase of the intake cam 33, the phase of the exhaust cam 35, and the exhaust pressure in the first cylinder C1. In FIG. 5, a dashed line L1 indicates the lift amount of the exhaust cam 35. A dashed dotted line L2 indicates the lift amount of the intake cam 33. A solid line L3 indicates the exhaust pressure.

As depicted by L1 in FIG. 5, the exhaust valve 34 is opened before the piston of the first cylinder C1 reaches a bottom dead center (BDC) corresponding to a crank angle of 180 degrees. With this configuration, exhaust blowdown in which the exhaust pressure greatly increases occurs around a point of time that the piston reaches the bottom dead center (BDC) corresponding to a crank angle of 180 degrees (see range A1). On the other hand, a condition that both the intake valve 32 and the exhaust valve 34 are opened (hereinafter referred to as "valve overlap") occurs around a point of time that the piston reaches a top dead center (TDC) corresponding to a crank angle of 360 degrees (see range A2).

Figure 6:
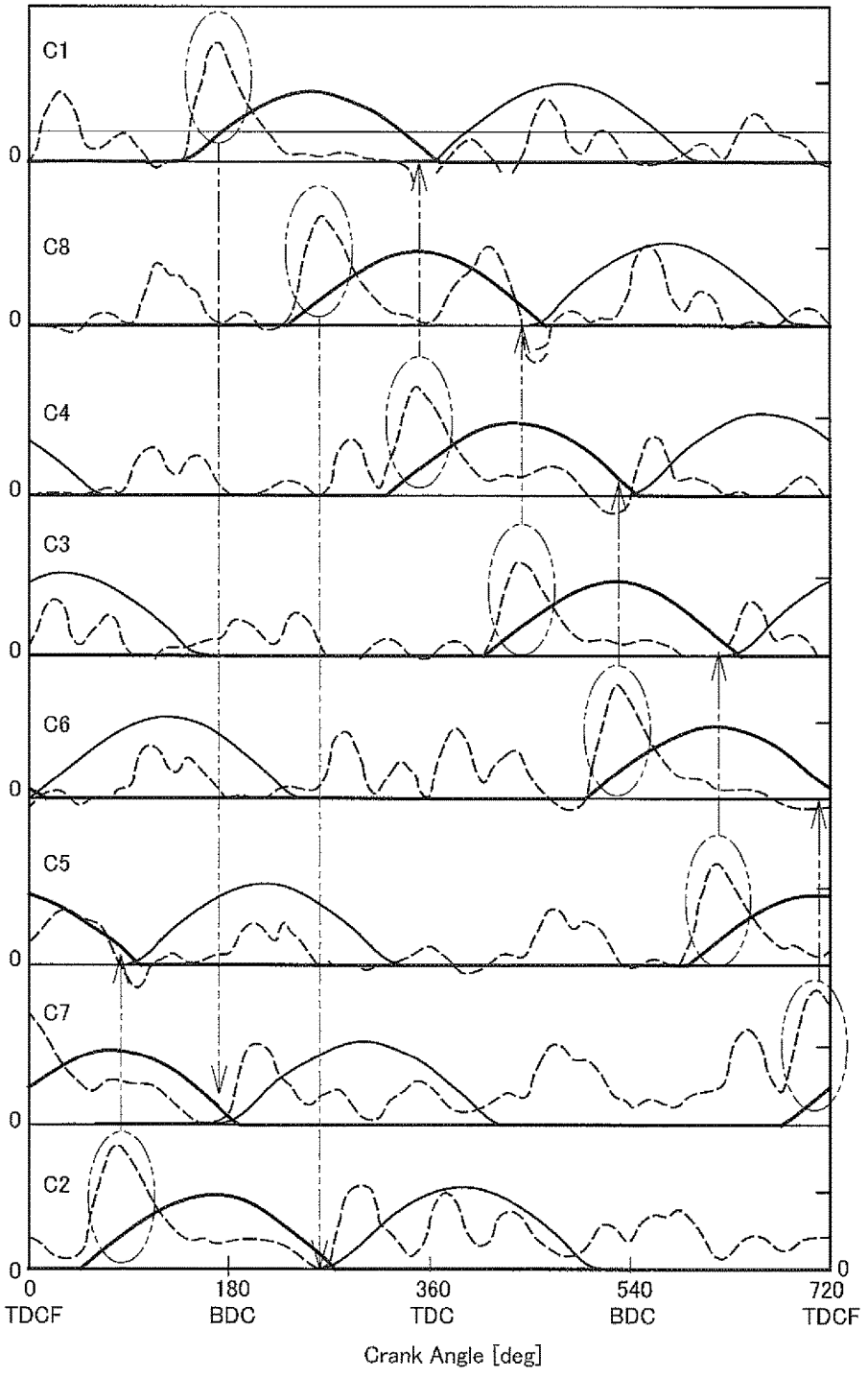
FIG. 6 includes timing charts, each showing the phase of an intake cam, the phase of an exhaust cam, and exhaust pressure in each of first to eighth cylinders.

FIG. 6 includes timing charts, each showing the phase of the intake cam 33, the phase of the exhaust cam 35, and the exhaust pressure in each of the first to eighth cylinders C1 to C8. In FIG. 6, the timing charts of the cylinders C1 to C8 are arranged from top to bottom in accordance with the sequential order of firing. In other words, firing is sequentially conducted in the first cylinder C1, the eighth cylinder C8, the fourth cylinder C4, the third cylinder C3, the sixth cylinder C6, the fifth cylinder C5, the seventh cylinder C7, and then the second cylinder C2. Therefore, firing is conducted in the four cylinders C1, C3, C5, and C7 of the first bank 21 at uneven intervals. Firing is conducted in the four cylinders C2, C4, C6, and C8 of the second bank 22 at uneven intervals.

In FIG. 6, arrows indicate relationships between cylinders in which exhaust interference occurs. As shown in FIG. 6, exhaust interference occurs between pairs of cylinders in which a point of time of exhaust blowdown and a point of time of valve overlap are matched. Relationships in exhaust interference are summarized in the following Table 1.

TABLE 1

| Interfering Cylinder | | Interfered Cylinder | Intra-bank Interference | Inter-bank Interference |
|---|---|---|---|---|
| C1 | ⇒ | C7 | ✓ | |
| C2 | ⇒ | C5 | | ✓ |
| C3 | ⇒ | C8 | | ✓ |
| C4 | ⇒ | C1 | | ✓ |
| C5 | ⇒ | C3 | ✓ | |
| C6 | ⇒ | C4 | ✓ | |
| C7 | ⇒ | C6 | | ✓ |
| C8 | ⇒ | C2 | ✓ | |

As shown in Table 1, the seventh cylinder C7, the third cylinder C3, the fourth cylinder C4, and the second cylinder C2 are respectively exposed to intra-bank exhaust interference. During valve overlap, exhaust gas reversely flows into a cylinder exposed to exhaust interference, and volumetric efficiency degrades in this cylinder.

In the engine 3 according to the present preferred embodiment, the central angle of the exhaust cam 35 for a cylinder exposed to intra-bank exhaust interference (i.e., the seventh and third cylinders C7 and C3 in the first bank 21 and the fourth and second cylinders C4 and C2 in the second bank 22) is larger than that of the exhaust cam 35 for a cylinder causing intra-bank exhaust interference (i.e., the first and fifth cylinders C1 and C5 in the first bank 21 and the sixth and eighth cylinders C6 and C8 in the second bank 22). As a result, the timing of starting opening the exhaust valve 34 is shifted earlier in a cylinder liable to be exposed to exhaust interference. This results in shortening the period of valve overlap in which both the exhaust valve 34 and the intake valve 32 are opened. During exhaust blowdown, exhaust interference occurs in a cylinder that is in the period of valve overlap. Therefore, exposure to exhaust interference is difficult due to shortening of the period of valve overlap.

It should be noted that inter-bank exhaust interference is less effective. Hence, regulation of the valve overlap period as described above may not be done for a cylinder exposed to inter-bank exhaust interference. However, regulation of the valve overlap period may be similarly done for the cylinder exposed to inter-bank exhaust interference.

FIG. 7 shows settings of the intake cams 33 and the exhaust cams 35 for the first to eighth cylinders C1 to C8 according to a first practical example. In FIG. 7, WA indicates the angle of action of a cam. In FIG. 7, EA indicates the central angle of a cam. As shown in FIG. 5, the angle of action WA means the angle of the lobe of a cam. The central angle EA means the angle from the middle of the angle of action WA to the exhaust top dead center (TDC).

As shown in FIG. 7, among the first to eighth cylinders C1 to C8, the angles of action WA of the intake cams 33 are equal and the central angles EA of the intake cams 33 are also equal. The angles of action WA of the exhaust cams 35 are equal among the first to eighth cylinders C1 to C8. It should be noted that the central angles EA of the exhaust cams 35 (hereinafter simply referred to as "exhausts EA") are partially different without being equal among the first to eighth cylinders C1 to C8.

When described in detail, the exhausts EA for the second and third cylinders C2 and C3 are respectively larger than those for the first and sixth cylinders C1 and C6. The exhausts EA for the second and third cylinders C2 and C3 are respectively larger than those for the fifth and eighth cylinders C5 and C8.

The exhausts EA for the fourth and seventh cylinders C4 and C7 are respectively larger than those for the first and sixth cylinders C1 and C6. The exhausts EA for the fourth and seventh cylinders C4 and C7 are respectively larger than those for the fifth and eighth cylinders C5 and C8.

The exhausts EA for the second and third cylinders C2 and C3 are respectively equal to those for the fourth and seventh cylinders C4 and C7. The exhausts EA for the first and sixth cylinders C1 and C6 are respectively equal to those for the fifth and eighth cylinders C5 and C8.

As shown in FIG. 6, firing is conducted in the seventh and fifth cylinders C7 and C5 at an interval corresponding to a crank angle of 90 degrees, and firing in the seventh cylinder C7 is conducted after firing in the fifth cylinder C5. Therefore, regarding a pair of cylinders of the first bank 21 in which firing is conducted at an interval corresponding to a crank angle of 90 degrees, the exhaust EA for one cylinder in which firing is conducted later (the seventh cylinder C7) is larger than that for the other cylinder in which firing is conducted earlier (the fifth cylinder C5). Additionally, firing is conducted in the fourth and eighth cylinders C4 and C8 at an interval corresponding to a crank angle of 90 degrees, and firing in the fourth cylinder C4 is conducted after firing in the eighth cylinder C8. Therefore, regarding a pair of cylinders of the second bank 22 in which firing is conducted at an interval corresponding to a crank angle of 90 degrees, the exhaust EA for one cylinder in which firing is conducted later (the fourth cylinder C4) is larger than that for the other cylinder in which firing is conducted earlier (the eighth cylinder C8).

Firing is conducted in the third and first cylinders C3 and C1 at an interval corresponding to a crank angle of 270 degrees, and firing in the third cylinder C3 is conducted after firing in the first cylinder C1. Therefore, regarding a pair of cylinders of the first bank 21 in which firing is conducted at an interval corresponding to a crank angle of 270 degrees, the exhaust EA for one cylinder in which firing is conducted later (the third cylinder C3) is larger than that for the other cylinder in which firing is conducted earlier (the first cylinder C1). Additionally, firing is conducted in the second and sixth cylinders C2 and C6 at an interval corresponding to a crank angle of 270 degrees, and firing in the second cylinder C2 is conducted after firing in the sixth cylinder C6. Therefore, regarding a pair of cylinders of the second bank 22 in which firing is conducted at an interval corresponding to a crank angle of 270 degrees, the exhaust EA for one cylinder in which firing is conducted later (the second cylinder C2) is larger than that for the other cylinder in which firing is conducted earlier (the sixth cylinder C6).

In the first bank 21, firing is not consecutively conducted in the first and fifth cylinders C1 and C5. In the first bank 21, firing is not consecutively conducted in the third and seventh cylinders C3 and C7. Therefore, in the first bank 21, the exhausts EA for cylinders in which firing is not consecutively conducted are equal.

In the second bank 22, firing is not consecutively conducted in the second and fourth cylinders C2 and C4. In the second bank 22, firing is not consecutively conducted in the sixth and eighth cylinders C6 and C8. Therefore, in the second bank 22, the exhausts EA for cylinders in which firing is not consecutively conducted are equal.

When firing is conducted first in a predetermined one (the first cylinder C1) of the eight cylinders, the exhaust EA for a cylinder in which firing is conducted seventh (the seventh cylinder C7) is larger than that for the cylinder in which firing is conducted first (the first cylinder C1). The exhaust EA for a cylinder in which firing is conducted third (the fourth cylinder C4) is larger than that for a cylinder in which firing is conducted fifth (the sixth cylinder C6). The exhaust EA for a cylinder in which firing is conducted fourth (the third cylinder C3) is larger than that for a cylinder in which firing is conducted sixth (the fifth cylinder C5). The exhaust EA for a cylinder in which firing is conducted eighth (the second cylinder C2) is larger than that for a cylinder in which firing is conducted second (the eighth cylinder C8).

FIG. 8 shows settings of the intake cams 33 and the exhaust cams 35 for the first to eighth cylinders C1 to C8 according to a second practical example. In the second practical example, the exhausts EA for the first and sixth cylinders C1 and C6 are respectively different from those for the fifth and eighth cylinders C5 and C8. When described in detail, the exhausts EA for the fifth and eighth cylinders C5 and C8 are respectively smaller than those for the first and sixth cylinders C1 and C6. The other relationships among the exhausts EA are similar to those in the first practical example.

FIG. 9 shows settings of the intake cams 33 and the exhaust cams 35 for the first to eighth cylinders C1 to C8 according to a comparative example. As shown in FIG. 9, in the comparative example, among the first to eighth cylinders C1 to C8, the angles of action WA of the intake cams 33 are equal, and the central angles EA of the intake cams 33 are also equal. Likewise, among the first to eighth cylinders C1 to C8, the angles of action WA of the exhaust cams 35 are equal, and the central angles EA of the exhaust cams 35 are also equal.

FIG. 10 is a table for showing values of maximum BMEP (Brake Mean Effective Pressure), output horsepower HP, and volumetric efficiency in the first practical example, those in the second practical example, and those in the comparative example. The volumetric efficiency indicates a ratio of intake air volume to exhaust volume. In FIG. 10, the values of the maximum BMEP, the output horsepower HP, and the volumetric efficiency were calculated based on simulation where the engine rotational speed was 6000 rpm. As shown in FIG. 10, the values of the maximum BMEP, the output horsepower HP, and the volumetric efficiency in the first practical example were all better than those in the comparative example. Likewise, the values of the maximum BMEP, the output horsepower HP, and the volumetric efficiency in the second practical example were all better than those in the comparative example.

Figure 11:
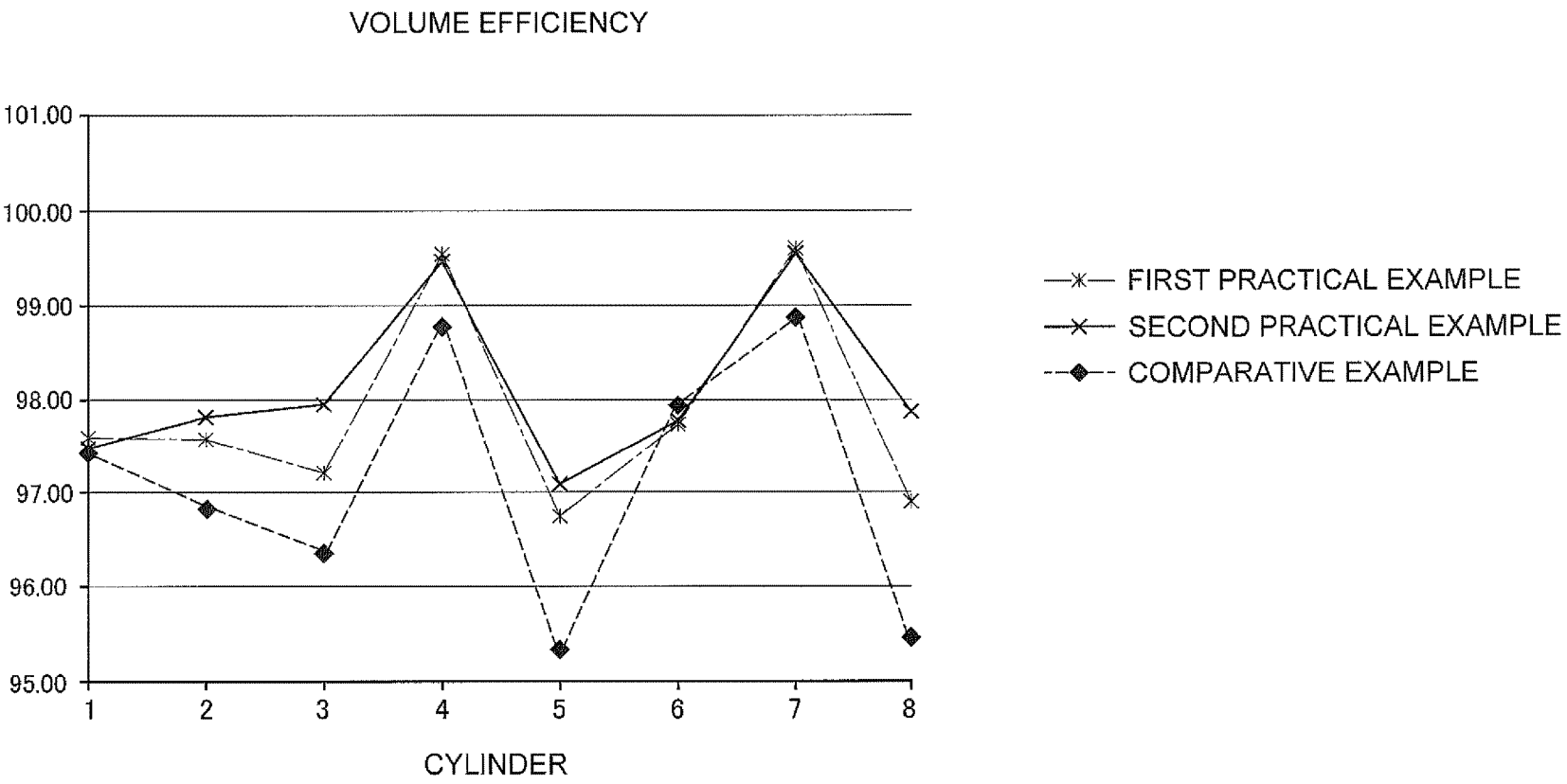
FIG. 11 is a chart for showing values of volumetric efficiency in the first to eighth cylinders.

FIG. 11 is a chart for showing values of volumetric efficiency in the respective cylinders C1 to C8. In FIG. 11, the values of volumetric efficiency were calculated based on simulation where the engine rotational speed was 6000 rpm. As shown in FIG. 11, the values of volumetric efficiency in cylinders exposed to exhaust interference (the third and seventh cylinders C3 and C7 of the first bank 21 and the second and fourth cylinders C2 and C4 of the second bank 22) in both of the first and second practical examples were better than those in the comparative example. It should be noted that in the first practical example, the exhausts EA for the first and sixth cylinders C1 and C6 are respectively equal to those for the fifth and eighth cylinders C5 and C8. In other words, compared to the second practical example, the first practical example has less variation in the exhaust EA. Accordingly, the number of variations in cam shape is reduced and the engine structure is simplified.

Figure 12:
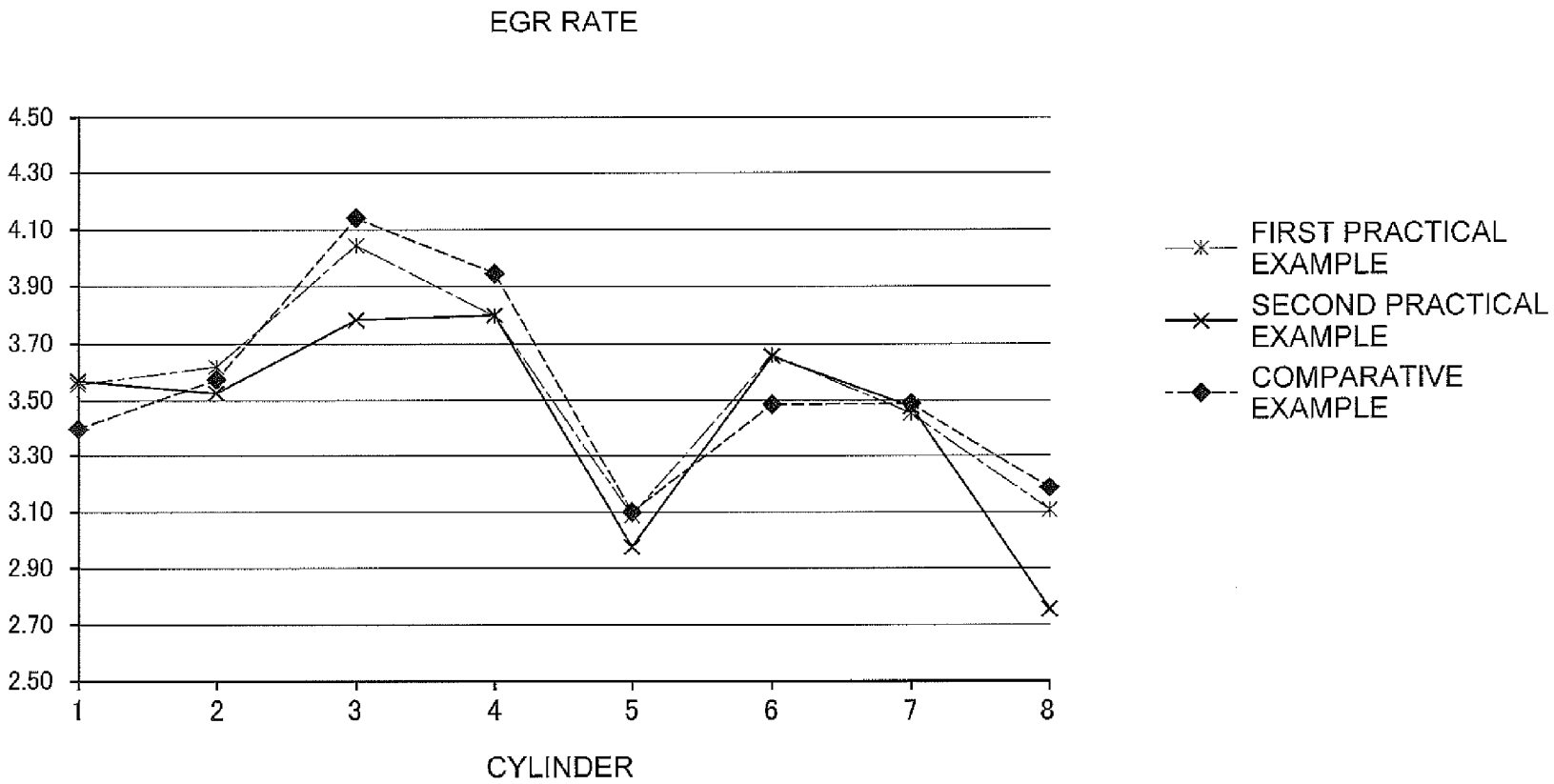
FIG. 12 is a chart for showing values of EGR rate in the first to eighth cylinders.

FIG. 12 is a chart for showing values of EGR (Exhaust Gas Recirculation) rate. The value of EGR rate is calculated by dividing the volume of exhaust gas recirculating to the intake system by the volume of intake air. In FIG. 12, the values of EGR rate were calculated based on simulation where the engine rotational speed was 6000 rpm. As shown in FIG. 12, the values of EGR rate in the first and second practical examples were better as a whole than those in the comparative example.

As described above, in the V8 engine 3 according to the present practical example, exhaust interference is inhibited by the settings of the central angles of the exhaust cams 35. Accordingly, exhaust interference is inhibited in the V8 engine 3 with a simple construction.

In the first and second practical examples, the central angles EA of the intake cams 33 are equal among the first to eighth cylinders C1 to C8. Additionally, the exhausts EA for the second and third cylinders C2 and C3 are respectively equal to those for the fourth and seventh cylinders C4 and C7. Accordingly, the number of variations in cam shape is reduced, and the engine structure is further simplified.

Various preferred embodiments of the present invention have been explained above. However, the present invention is not limited to the above-described preferred embodiments, and a variety of changes can be made without departing from the scope of the present invention.

The order of firing in the cylinders is not limited to the above and may be changed.

The central angles EA of the intake cams 33 for the cylinders may be set differently from each other. In other words, the central angle EA of the intake cam 33 for a cylinder exposed to exhaust interference may be larger than that of the intake cam 33 for a cylinder causing exhaust interference.

For example, the central angles EA of the intake cams 33 for the third and seventh cylinders C3 and C7 of the first bank 21 may be respectively larger than those of the intake cams 33 for the first and fifth cylinders C1 and C5 of the first bank 21. The central angles EA of the intake cams 33 for the second and fourth cylinders C2 and C4 of the second bank 22 may be larger than those of the intake cams 33 for the sixth and eighth cylinders C6 and C8 of the second bank 22.

The angles of action WA of the exhaust cams 35 for the cylinders may be set differently from each other. In other words, the angle of action WA of the exhaust cam 35 for a cylinder exposed to exhaust interference may be larger than that of the exhaust cam 35 for a cylinder causing exhaust interference.

The exhausts EA for the second and third cylinders C2 and C3 may be set differently from those for the fourth and seventh cylinders C4 and C7. The exhausts EA for the first and sixth cylinders C1 and C6 may be set differently from those for the fifth and eighth cylinders C5 and C8.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A V8 engine comprising:

a first bank including four cylinders;

a second bank including four cylinders, the second bank being disposed in a V-shaped alignment with the first bank;

an exhaust pathway including a first aggregated portion and a second aggregated portion, the first aggregated portion joining exhaust gases from the four cylinders of the first bank therein, and the second aggregated portion joining exhaust gases from the four cylinders of the second bank therein;

a plurality of exhaust valves that open and close exhaust ports in the cylinders; and a plurality of exhaust cams that drive the plurality of exhaust valves; wherein firing is conducted in the eight cylinders at intervals corresponding respectively to a crank angle of 90 degrees;

the firing is conducted in the four cylinders of the first bank at uneven intervals;

the firing is conducted in the four cylinders of the second bank at uneven intervals;

in a pair of cylinders of the first bank in which the firing is consecutively conducted at an interval corresponding to a crank angle of 90 degrees, a central angle of the exhaust cam provided for one cylinder in which the firing is conducted later is larger than a central angle of the exhaust cam provided for the other cylinder in which the firing is conducted earlier in order to start opening the exhaust valve for the one cylinder earlier;

in a pair of cylinders of the second bank in which the firing is consecutively conducted at an interval corresponding to a crank angle of 90 degrees, a central angle of the exhaust cam provided for one cylinder in which the firing is conducted later is larger than a central angle of the exhaust cam provided for the other cylinder in which the firing is conducted earlier in order to start opening the exhaust valve for the one cylinder earlier;

in a pair of cylinders of the first bank in which the firing is consecutively conducted at an interval corresponding to a crank angle of 270 degrees, a central angle of the exhaust cam provided for one cylinder in which the firing is conducted later is larger than a central angle of the exhaust cam provided for the other cylinder in which the firing is conducted earlier in order to start opening the exhaust valve for the one cylinder earlier; and in a pair of cylinders of the second bank in which the firing is consecutively conducted at an interval corresponding to a crank angle of 270 degrees, a central angle of the exhaust cam provided for one cylinder in which the firing is conducted later is larger than a central angle of the exhaust cam provided for the other cylinder in which the firing is conducted earlier in order to start opening the exhaust valve for the one cylinder earlier.

2. The V8 engine according to claim 1, wherein in each of the first and second banks, the central angles of the exhaust cams for cylinders in which the firing is not consecutively conducted are equal.

3. The V8 engine according to claim 1, further comprising:

a plurality of intake valves that open and close intake ports of the cylinders; and a plurality of intake cams that drive the plurality of intake valves; wherein central angles of the plurality of intake cams for the eight cylinders are equal.

4. The V8 engine according to claim 1, wherein the first bank includes a first cylinder, a third cylinder, a fifth cylinder, and a seventh cylinder;

the second bank includes a second cylinder, a fourth cylinder, a sixth cylinder, and an eighth cylinder; and the firing is sequentially conducted in the first cylinder, the eighth cylinder, the fourth cylinder, the third cylinder, the sixth cylinder, the fifth cylinder, the seventh cylinder, and then the second cylinder.

5. The V8 engine according to claim 1, wherein the first aggregated portion and the second aggregated portion are disposed between the first bank and the second bank.

6. The V8 engine according to claim 5, wherein the exhaust pathway further includes a third aggregated portion that joins the first aggregated portion and the second aggregated portion; and the third aggregated portion is disposed between the first bank and the second bank.

7. The V8 engine according to claim 6, further comprising a catalyst disposed within the third aggregated portion.

8. A V8 engine comprising:

a first bank including four cylinders;

a second bank including four cylinders, the second bank being disposed in a V-shaped alignment with the first bank;

an exhaust pathway including a first aggregated portion and a second aggregated portion, the first aggregated portion joining exhaust gases from the four cylinders of the first bank therein, and the second aggregated portion joining exhaust gases from the four cylinders of the second bank therein;

a plurality of exhaust valves that open and close exhaust ports of the cylinders; and a plurality of exhaust cams that drive the plurality of exhaust valves; wherein firing is conducted in the eight cylinders at intervals respectively corresponding to a crank angle of 90 degrees, and when the firing is conducted first in a predetermined cylinder of the eight cylinders:

a central angle of the exhaust cam provided for a cylinder in which the firing is conducted seventh is larger than a central angle of the exhaust cam provided for the predetermined cylinder in which the firing is conducted first in order to start opening the exhaust valve earlier for the cylinder in which the firing is conducted seventh;

a central angle of the exhaust cam provided for a cylinder in which the firing is conducted third is larger than a central angle of the exhaust cam provided for a cylinder in which the firing is conducted fifth in order to start opening the exhaust valve earlier for the cylinder in which the firing is conducted third;

a central angle of the exhaust cam provided for a cylinder in which the firing is conducted fourth is larger than a central angle of the exhaust cam provided for a cylinder in which the firing is conducted sixth in order to start opening the exhaust valve earlier for the cylinder in which the firing is conducted fourth; and a central angle of the exhaust cam provided for a cylinder in which the firing is conducted eighth is larger than a central angle of the exhaust cam provided for a cylinder in which the firing is conducted second in order to start opening the exhaust valve earlier for the cylinder in which the firing is conducted eighth.

9. The V8 engine according to claim 8, wherein the cylinder in which the firing is conducted seventh and the cylinder in which the firing is conducted first are included in the same bank;

the cylinder in which the firing is conducted third and the cylinder in which the firing is conducted fifth are included in the same bank;

the cylinder in which the firing is conducted fourth and the cylinder in which the firing is conducted sixth are included in the same bank; and the cylinder in which the firing is conducted eighth and the cylinder in which the firing is conducted second are included in the same bank.

10. The V8 engine according to claim 8, wherein, in each of the first and second banks, the central angles of the exhaust cams provided for cylinders in which the firing is not consecutively conducted are equal.

11. The V8 engine according to claim 8, further comprising:

a plurality of intake valves that open and close intake ports of the cylinders; and a plurality of intake cams that drive the plurality of intake valves; wherein central angles of the intake cams for the eight cylinders are equal.

12. The V8 engine according to claim 8, wherein the first aggregated portion and the second aggregated portion are disposed between the first bank and the second bank.

13. The V8 engine according to claim 12, wherein the exhaust pathway further includes a third aggregated portion joining the first aggregated portion and the second aggregated portion; and the third aggregated portion is disposed between the first bank and the second bank.

14. The V8 engine according to claim 13, further comprising a catalyst disposed within the third aggregated portion.

15. An outboard motor comprising:

the V8 engine according to claim 1;

a driveshaft driven by the engine and extending in a vertical direction; and a propeller shaft connected to the driveshaft and extending in a direction perpendicular or substantially perpendicular to the driveshaft.

* * * * *